US006974040B2

(12) United States Patent
Jährling

(10) Patent No.: US 6,974,040 B2
(45) Date of Patent: Dec. 13, 2005

(54) CONTAINER IN THE FORM OF A COMPARTMENT FOR DOMESTIC APPLIANCE

(75) Inventor: Peter Jährling, Bünde (DE)

(73) Assignee: Paul Hettich GmbH & Co., Kirchlengern (DE)

( * ) Notice: Subject to any disclaimer, the term of this patent is extended or adjusted under 35 U.S.C. 154(b) by 123 days.

(21) Appl. No.: 10/259,662

(22) Filed: Sep. 30, 2002

(65) Prior Publication Data

US 2003/0075517 A1 Apr. 24, 2003

(30) Foreign Application Priority Data

Oct. 24, 2001 (DE) ..... 201 17 421 U

(51) Int. Cl.[7] ..... A47G 19/08

(52) U.S. Cl. ..... 211/41.8; 211/175; 211/181.1; 312/334.4

(58) Field of Search ..... 211/41.8, 41.9, 211/181.1, 175; D32/1–3, 55; 248/297.21, 295.11, 299.1; 312/311, 332.1, 333, 334.4

(56) References Cited

U.S. PATENT DOCUMENTS 3,472,573 A * 10/1969 Geiger ..... 312/351
3,560,069 A * 2/1971 Doepke ..... 312/351
3,726,580 A * 4/1973 Guth ..... 312/351
3,726,581 A * 4/1973 Doepke ..... 312/351
3,768,883 A * 10/1973 Kauffman ..... 312/351
3,809,450 A * 5/1974 Guth ..... 312/351
4,064,887 A * 12/1977 Geiger et al. ..... 134/144
4,097,099 A * 6/1978 Spiegel ..... 312/311
5,474,378 A * 12/1995 Smith et al. ..... 312/334.4
5,480,035 A * 1/1996 Smith ..... 211/41.8
5,657,878 A * 8/1997 Austin ..... 211/41.8
5,860,716 A * 1/1999 Good et al. ..... 312/311
6,247,771 B1 * 6/2001 Miller ..... 312/310

FOREIGN PATENT DOCUMENTS

DE 27 01 879 A1 7/1978
DE 42 27 585 A1 2/1994
FR 1335491 7/1963

* cited by examiner

*Primary Examiner*—Carl D. Friedman
*Assistant Examiner*—Jennifer E. Novosad
(74) *Attorney, Agent, or Firm*—Barnes & Thornburg LLP

(57) ABSTRACT

A container for a domestic appliance, comprising: guides for lateral movement of the container with respect to a domestic appliance; a device for one or more of vertically adjusting and inclining of the container, including supporting members associated with the container; supporting brackets connected to and extending upwards from the guides and supporting the container; and index stops on one of the supporting members an supporting brackets and index notches on one of the supporting members and supporting brackets, the index stops cooperating with the index notches to one or more of vertically adjust and incline the container.

14 Claims, 9 Drawing Sheets

1
21
9
4
5
7
2
3

CONTAINER IN THE FORM OF A COMPARTMENT FOR DOMESTIC APPLIANCE

BACKGROUND AND SUMMARY OF INVENTION

This invention relates generally to a container in the form of a compartment for domestic appliances. The container can move, along guides provided laterally, from a home position inside the domestic appliance to a feeding position situated in front of the domestic appliance. The container is fitted with a means or device for vertical adjustment which can bring the container to various heights in relation to the guides, as well as in various inclined positions.

Containers in the form of a compartment are already known, especially those whereby the height of the container can be adjusted with respect to the guides and be inclined in various directions.

So far, the known means for vertical adjustment are relatively cumbersome, for example, with arrangements wherein height can be adjusted using pinions, cams or curves.

The vertical adjustment of the container is generally desirable since it enables the accommodation of larger objects. For example, saucepans or similar items in the case of dish compartments in dishwashers. Or, in the case of containers in refrigerators or freezers, the vertical adjustment provides optimal filling and usage of the space available in the domestic appliance.

A purpose of the present invention is to provide a container in the form of a compartment that is composed of few and cost efficient parts and fitted with a user-friendly device for vertical adjustment.

This is accomplished by having a means or device for vertical adjustment comprised of supporting brackets attached to guides. The brackets extend vertically over the guides upwards and the brackets are fitted with index notches. The vertical adjustment device further has supporting members, associated with or connected to the container, whereby the supporting members have index stops. The supporting members can be inserted/retracted inside or between the index notches of the supporting brackets, which brackets support the container. The supporting members can extend from a contact area of the index notches of the supporting brackets by using a release handle that is monolithic or integral with or connected to the supporting member.

Since the device for vertical adjustment is comprised of relatively few parts, it is easy-to-build and extremely cost efficient to manufacture. It is also user-friendly since to release the container from a given position, it suffices to actuate the release handle which enables retraction of the index stops from the contact area of the index notches of the supporting brackets. After raising or lowering or possibly inclining the container, a new position of the container can be fixed simply by releasing or not actuating the release handle.

Other aspects, advantages and novel features of the present invention will become apparent from the following detail description of the invention when considered in conjunction with the accompanying drawings.

DETAILED DESCRIPTION OF THE PREFERRED EMBODIMENTS

Figure 1:
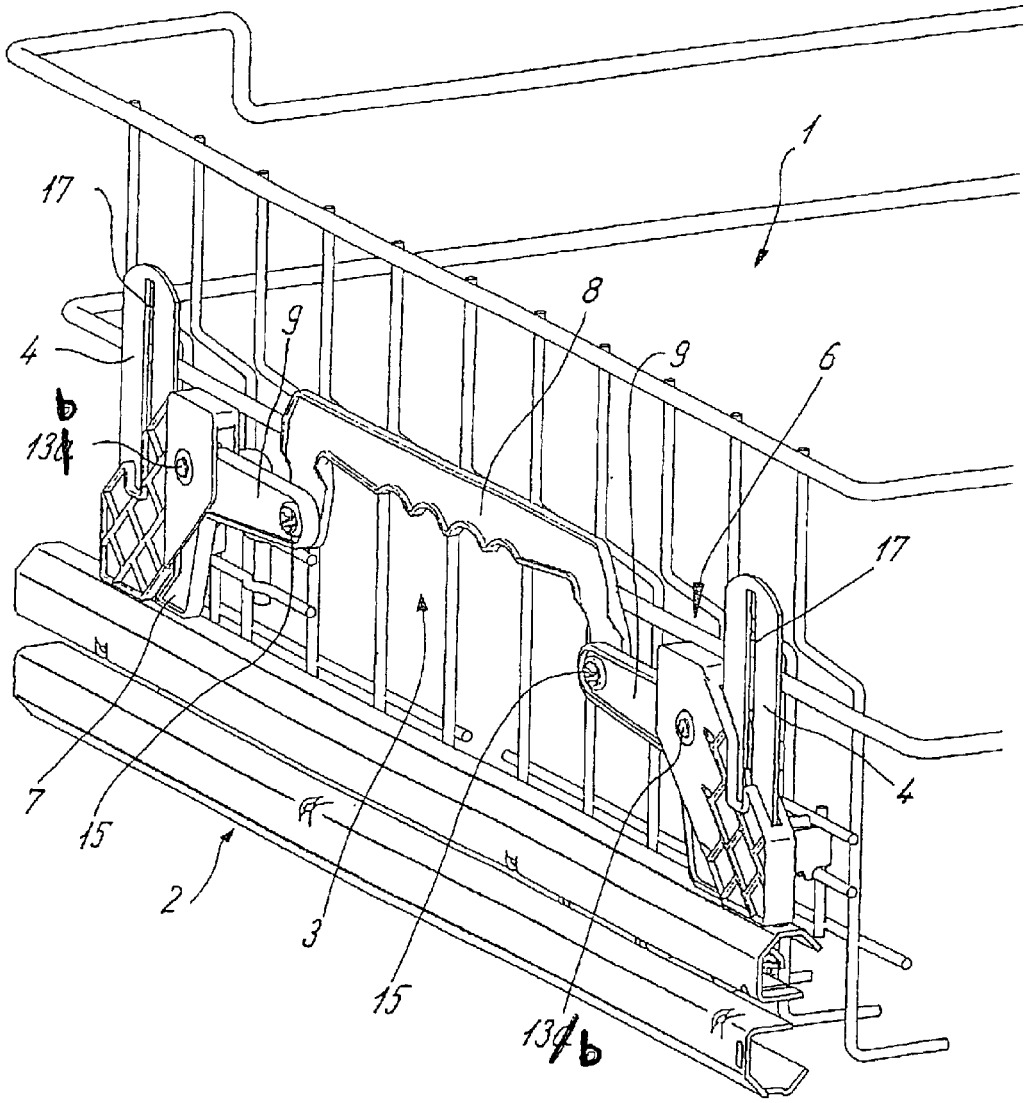
FIG. 1 is a perspective view of an embodiment of a container, according to the present invention.

FIG. 1 shows a container in the form of a compartment of a domestic appliance, particularly a dish compartment in a dishwasher.

The container 1 is mobile, along guides 2 provided laterally, from a home position inside a domestic appliance (not shown) for example, a dishwasher, to a feeding position (not shown) situated in front of the domestic appliance.

The container 1 has a means or device for vertical adjustment 3, which can adjust the container 1 to positions of various heights with respect to the guides 2, including various inclined positions. An inclined position may be achieved by raising or lowering an end of the container relative to an opposite end of the container.

The device 3 comprises supporting brackets 4 with index notches 5 and supporting members 6 associated with the container 1. The brackets 4 are fixed to the guides 2 and extend vertically upwards and over the guides 2. The supporting members 6 are fitted with index stops 7 which engage index notches 5 of the supporting brackets 4 and thereby support the container 1. Each supporting member 6 may also comprise or be connected to a release handle 8 to retract the index stops 7 from a contact area 5*a* of the index notches 5 of the supporting brackets 4.

Figure 5:
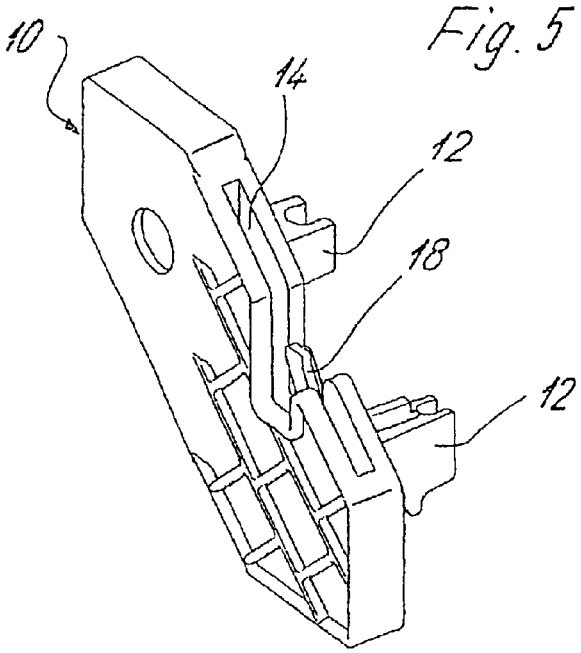
FIG. 5 is a perspective view of a casing, according to the present invention.
Figure 6:
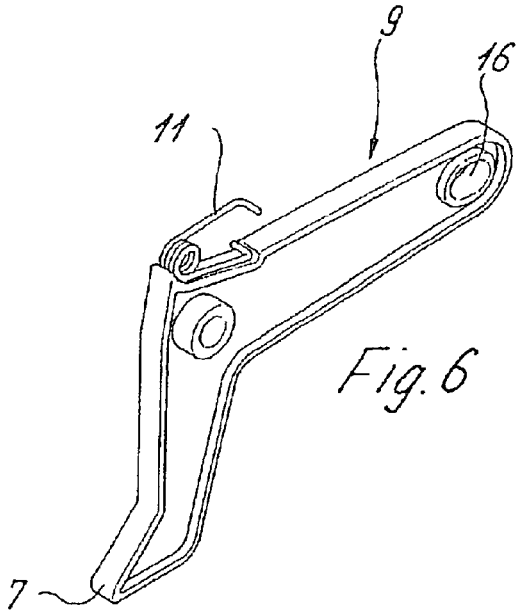
FIG. 6 is a perspective view of an angle lever, according to the present invention.

The index stops 7 may be formed monolithically or be integral with angle levers 9 (see FIG. 6). The levers 9 may be swivelably or pivotally connected with bearings (not shown) inside a casing 10. Such a connection may be by boss 23 on lever 9 and hole or bearing surface 25 on casing 10 (see FIGS. 5 and 6). The index stops 7 are formed in the area of one end of the angle lever 9 and a longitudinal or elongated slot or hole 16 is in the area of the other end. Thus, the angle levers 9 can also be connected to the release handle 8 in a pivoting or swivelling fashion through holes 16 and pins 15 on the release handle 8 (see FIG. 7).

The casings 10, may be fixed rigidly to the container 1 and may penetrate or be slidingly connected to the supporting brackets 4.

Figure 2:
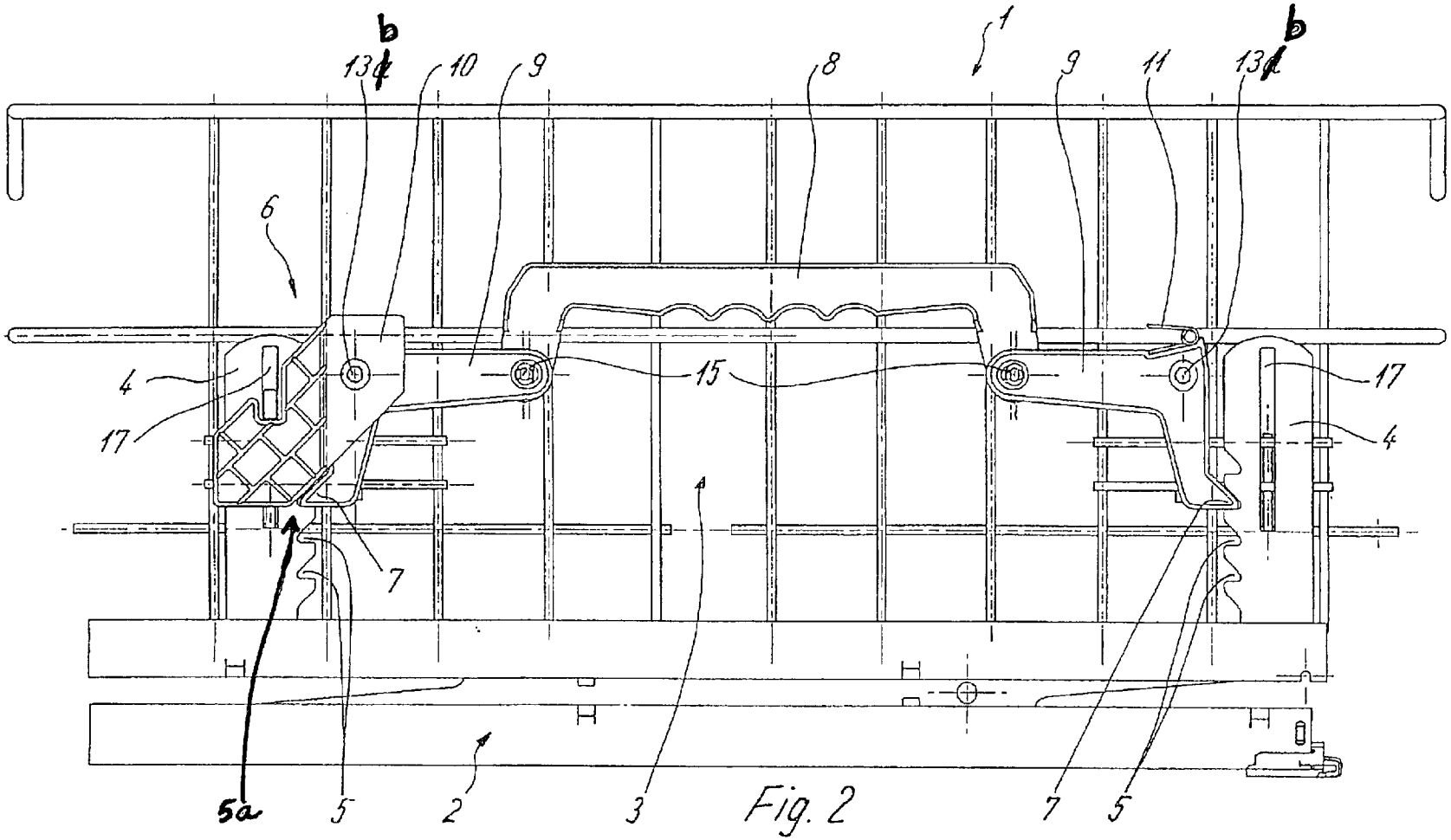
FIG. 2 is a side view of the container of FIG. 1 with a component omitted for clarity purposes.
Figure 3:
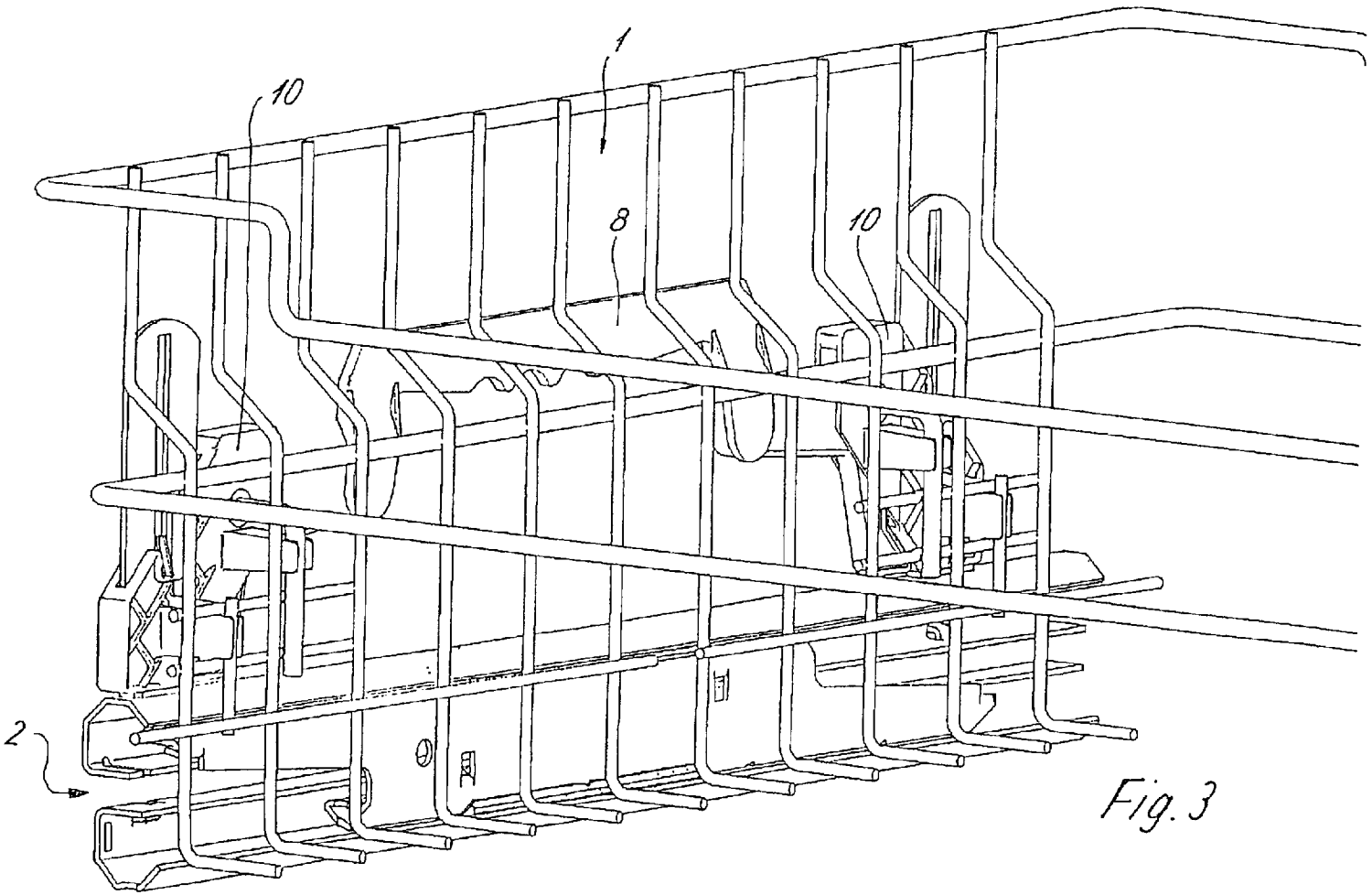
FIG. 3 is a perspective view of an inner side of the container, according to the present invention.

As shown on FIG. 2, each angle lever 9 is loaded by a spring 11 so that the index stops 7 are pressed towards and in an index notch 5. Inadvertent release of a set position of the container 1 is thereby avoided.

It should be noted that the container 1 is fitted on both its longitudinal sides with a device 3 so that the container 1 is supported evenly and correctly with respect to the supporting brackets 4 and, consequently, the guides 2.

Figure 11:
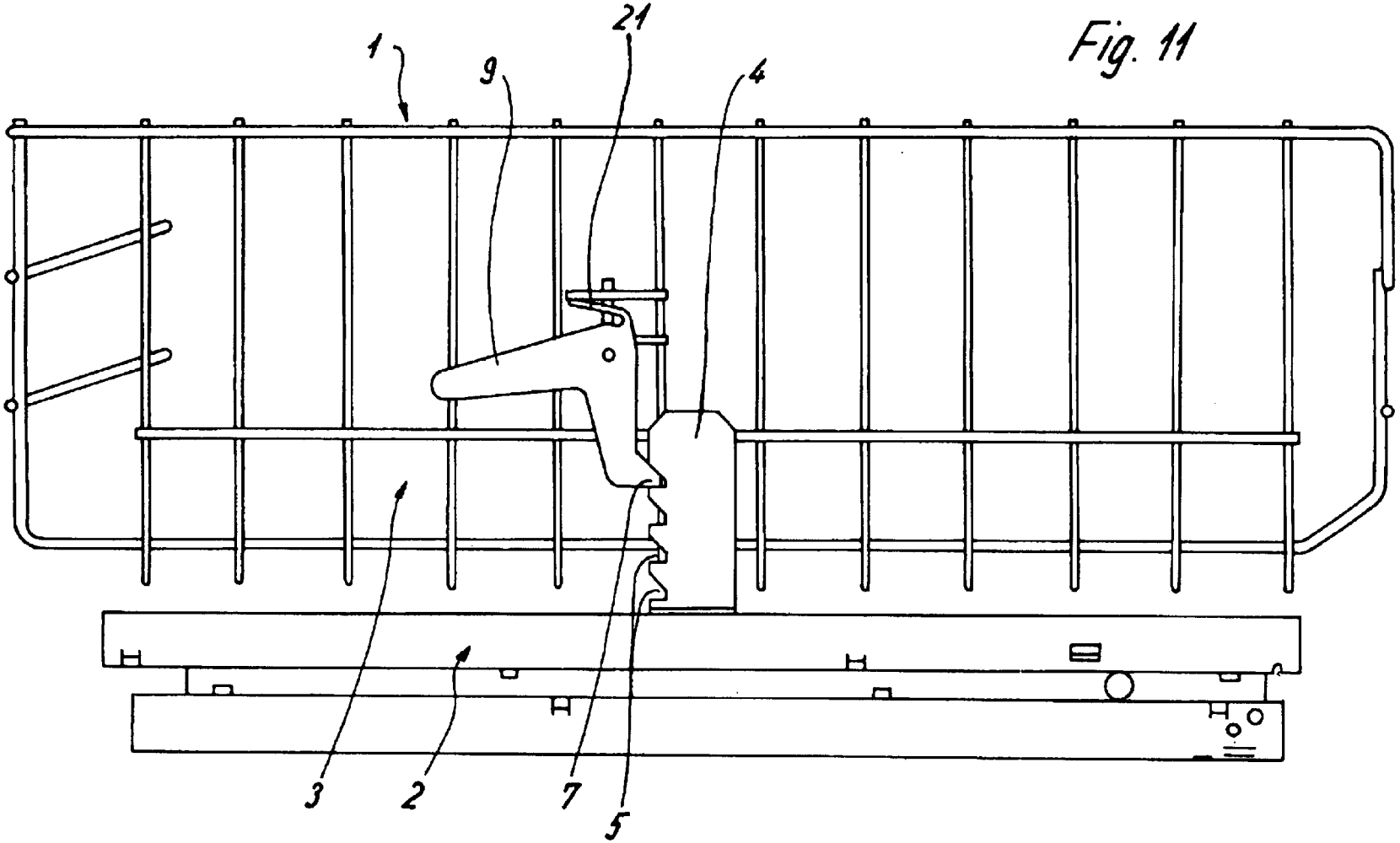
FIG. 11 is a side view of another embodiment of a container, according to the present invention.

It should also be noted that as an alternative embodiment, a three-point rest or arrangement can be formed so that two supporting brackets 4 may be provided on one side of container 1, at a distance from one another, and only one such supporting bracket 4 may be provided on the opposite side of container 1, as shown in FIG. 11.

Figure 4:
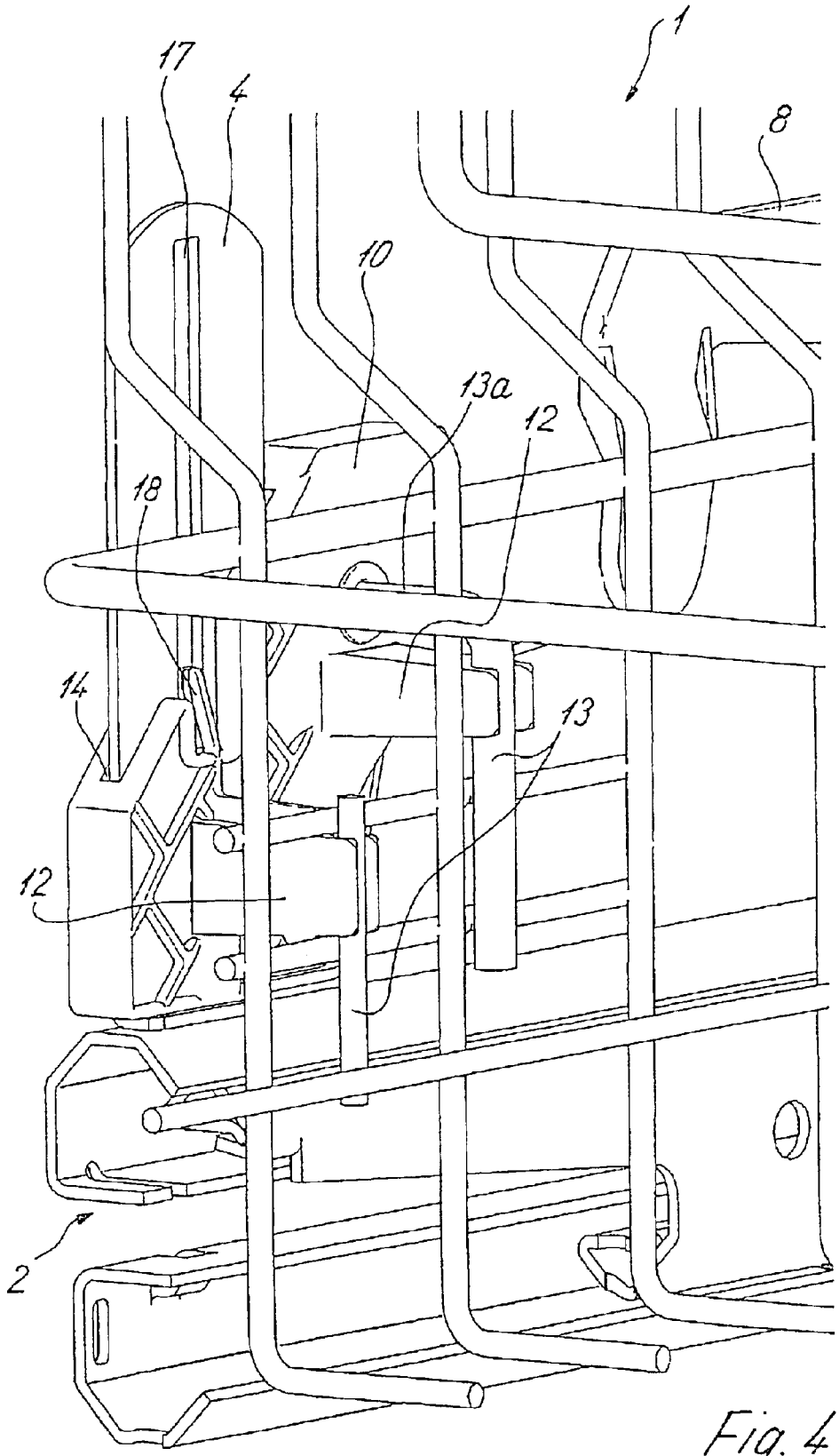
FIG. 4 is an enlarged view of a portion of FIG. 3.

The casings 10 are fitted with clamps or stirrups 12, which may be molded, as shown in FIG. 4, and which may attach the casings 10 to wires 13 of the container 1. Other equivalent attachment variations for fastening the casings 10 to the container 1 may be used.

One of the wires 13 can be run advantageously towards the casing 10 and engage the casing 10 with an extended leg 13*a* (see FIG. 4). The extended leg 13*a* can be used as a bearing or pivoting axis 13*b* for a corresponding angle lever 9.

As can be seen from FIGS. 4–5, each casing 10 may have a slot 14 which may be penetrated by a supporting bracket 4.

Figure 7:
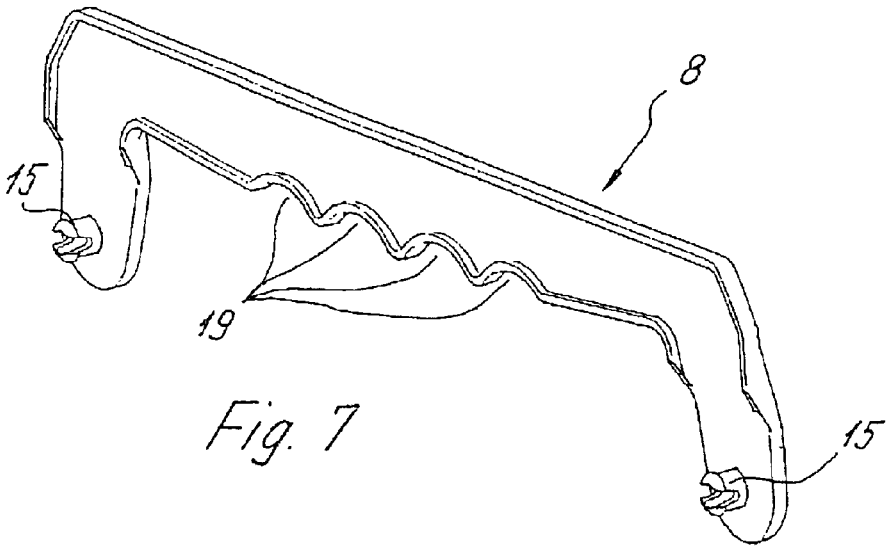
FIG. 7 is a perspective view of a release handle, according to the present invention.

Each release handle 8, as shown in FIG. 7, may have molded or inserted spring-loaded pins 15. These spring-loaded pins 15 can be inserted through holes 16 of the angle levers 9 (see FIG. 6) and form a pivoting axis between the release handle 8 and the angle levers 9. The holes 16 are built as elongated or longitudinal holes so that when actuating or raising the release handles 8, both angle levers 9 can pivot around their respective pivoting axis 13*b*, which causes the index stops 7 to disengage from the contact area 5*a* of the index notches 5.

Each time the release handles 8 are lowered or released, each angle lever 9 is returned to a connection position due to both pivoting strength and to spring 11, such that index stops 7 can move back to connect with one of the index notches 5 so that the container 1 rests again on the supporting brackets 4.

To prevent the container 1 from being lifted completely from or off the supporting brackets 4, the supporting brackets 4 each have, along their longitudinal axis, a longitudinal slot 17 that engages a spring-loaded nose 18 molded onto casing 10 (see FIGS. 4 and 5). The spring-loaded nose 18, at an upper end of slot 17, serves as a kind of end stop which prevents the container 1 from being lifted completely and inadvertently from the supporting brackets 4.

Advantageously, the casings 10, the angle levers 9 and the release handles 8 may each be made of synthetic or equivalent material. The casings 10 angle lever 9 and release handle 8 may each be made individually, or one or more may be made monolithic with the other.

The supporting brackets 4 may be made preferably of metal or equivalent material for better loading capacity.

The release handles 8 may have recessed grips 19, as shown on FIG. 7.

Figure 8:
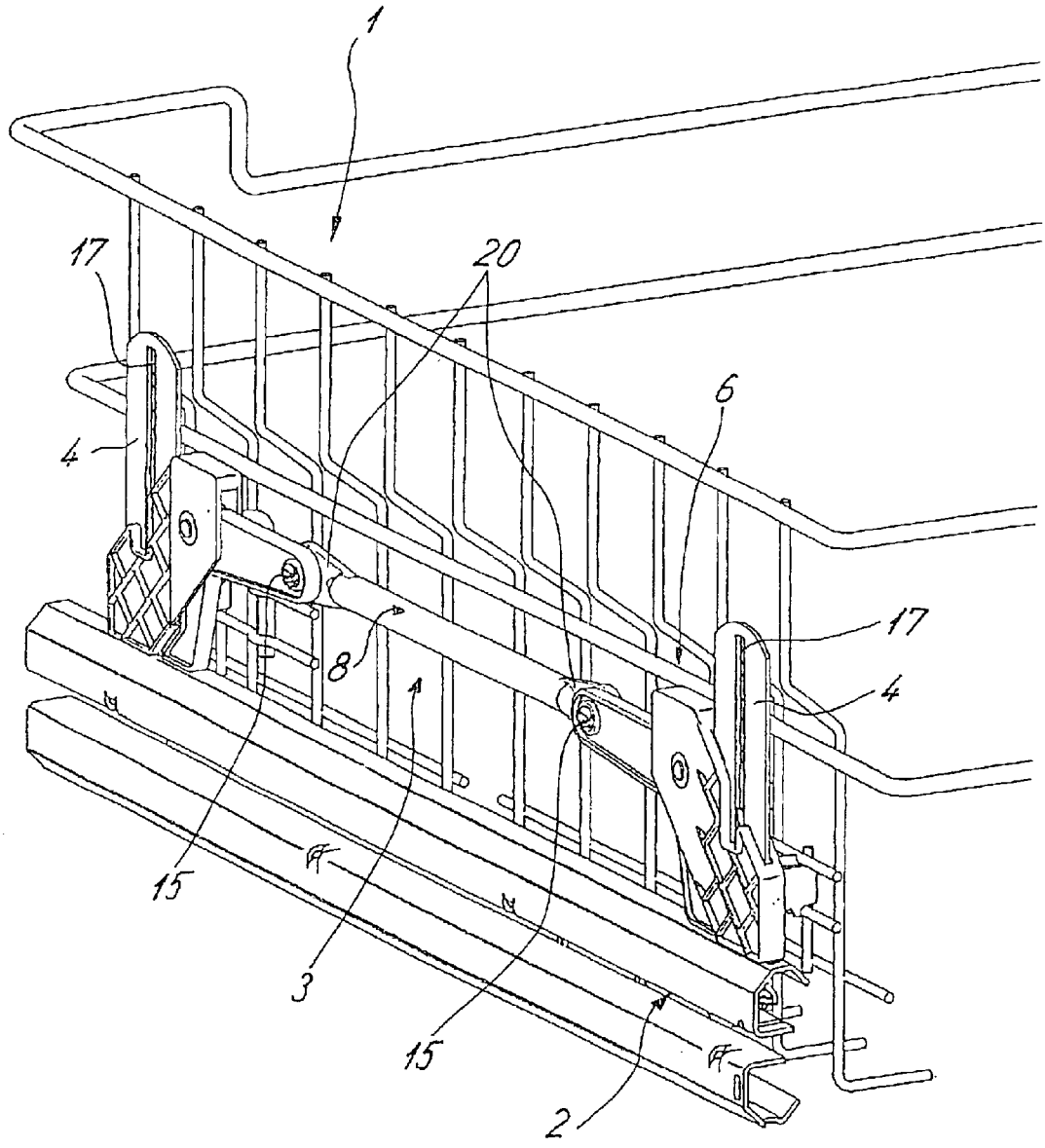
FIG. 8 is a perspective view of another embodiment of a container, according to the present invention.

Another embodiment, as shown in FIG. 8, corresponds in essence and in operation to the embodiment shown in FIGS. 1–7. However, the release handles 8 may comprise a pipe, rod sections or equivalent component or components having flattened head pieces 20 with molded spring-loaded pins 15, in bearing areas that may connect with angle levers 9.

Figure 9:
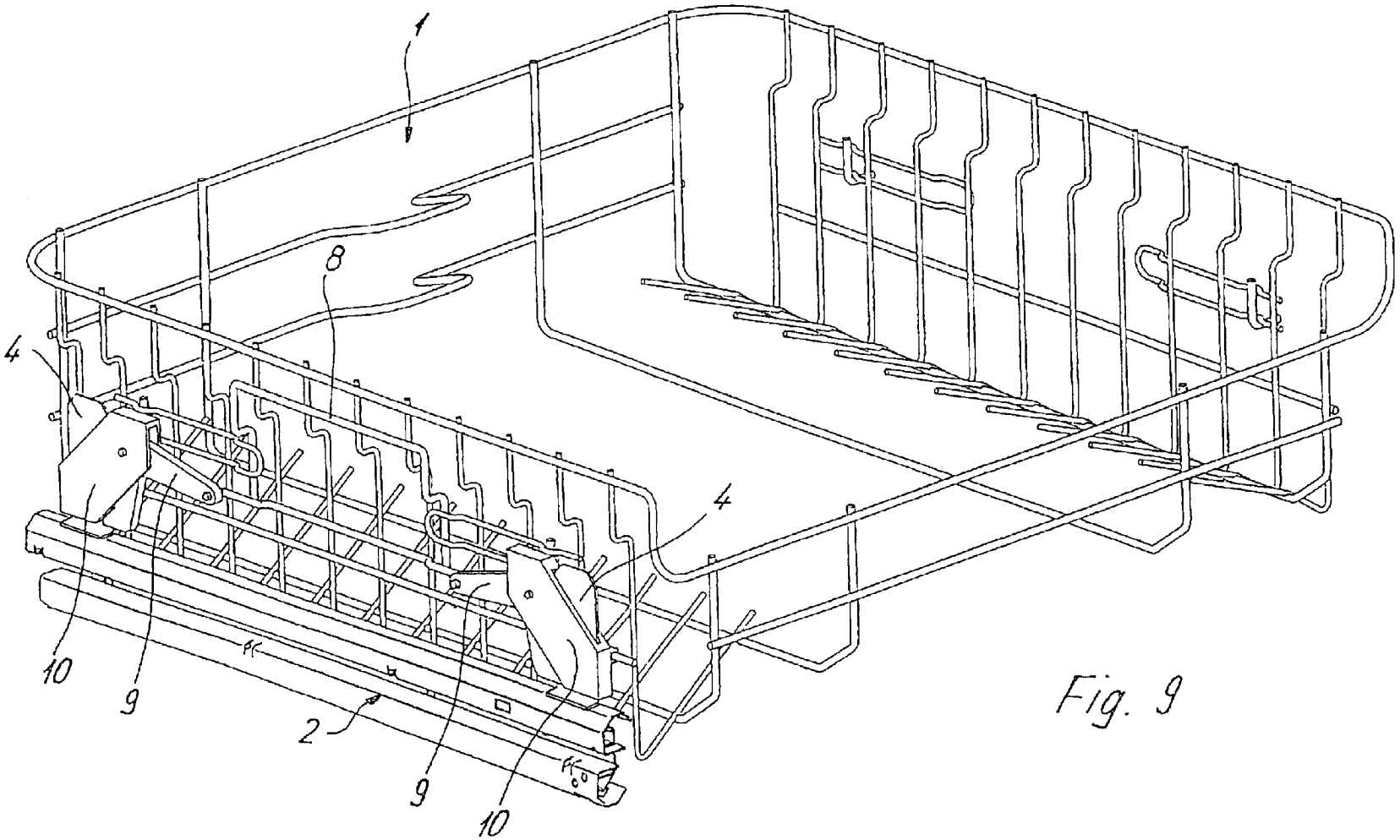
FIG. 9 is a perspective view of another embodiment of a container of the present invention.
Figure 10:
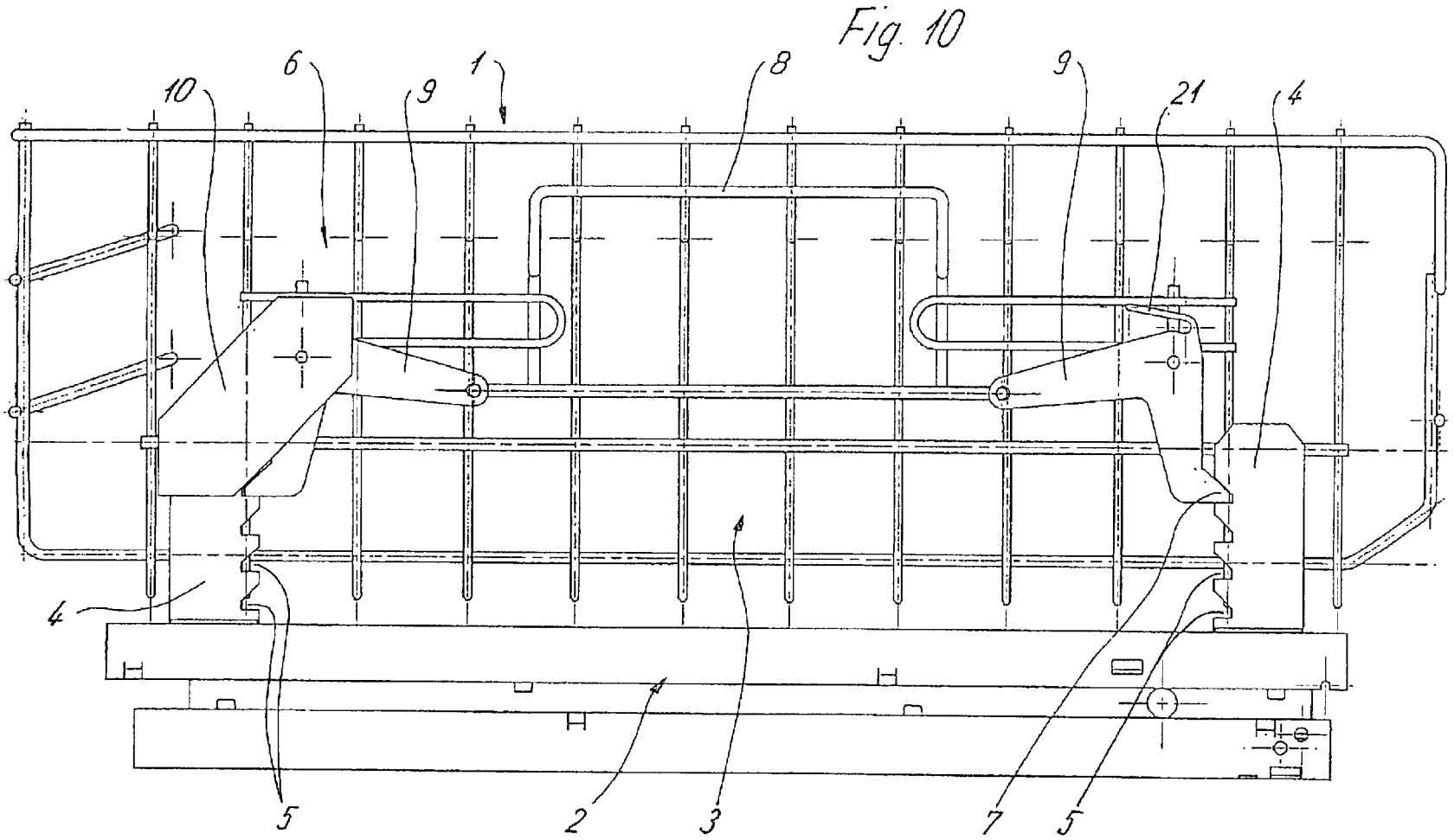
FIG. 10 is a side view of the container of FIG. 9.

FIGS. 9 and 10 show another embodiment of the invention wherein the release handles 8 comprise a supporting yoke, that may be formed from wire or equivalent material.

Moreover, FIG. 10 shows a spring-loaded bracket 21 that may be molded to the angle levers 9 and function similarly to spring 11, as shown in FIGS. 2 and 6.

All the embodiments of the present invention have means or devices for vertical adjustment 3 that comprise few, simple and cost efficient components and are extremely user-friendly.

The container 1 may be raised from a lower position (as shown in FIG. 1) upwards without actuating the release handles 8 since the index stops 7 can simply slip over the index notches 5 during an upward movement of the container 1.

The release handles 8 may be actuated or placed in an unlocked condition by raising the handle 8 to disengage the index stops 7 from the index notches 5. In that unlocked condition, the container 1 can thus be brought up or down to a desired position. After selecting a desired position, the release handles 8 can be released and the index stops 7 can engage into corresponding index notches 5.

Although the present invention has been described and illustrated in detail, it is to be clearly understood that this is done by way of illustration and example only and is not to be taken by way of limitation. The spirit and scope of the present invention are to be limited only by the terms of the appended claims.

We claim:

1. A container for a domestic appliance, comprising:

guides for permitting lateral movement of the container with respect t the domestic appliance; and a device for vertically adjusting and inclining the container, the device including at least one supporting bracket having index notches, and connected to the extending upwards from the guides, the at least one supporting bracket adapted to support the container and being located on one side of the container, at least two spaced-apart supporting brackets having index notches, and connected to and extending upwards from the guides, the at least two supporting brackets adapted to support the container and being located on the opposite side of the container, at least one supporting member including an angle lever having a fixed pivot point and having an index stop, the at least one supporting member being located on the one side of the container, at least two spaced-apart supporting members each including an angle lever having a fixed pivot point and having an index stop and a commonly-operated handle, and being located on the opposite side of the container, the angle lever of the at least one supporting member having a horizontally-oriented surface configured to permit a user to operate the angle lever of the at least one supporting member in such a manner to release the index stop of the at least one supporting member from the index notch and to vertically adjust and incline the container; and the commonly-operated handle having a horizontally-oriented surface configured to permit a user to operate the commonly-operated handle in a vertical direction to release the index stops of the at least two spaced-apart supporting members from the index notches and to vertically adjust and incline the container.

2. The container according to claim 1, wherein the at least two supporting brackets are fixed at a distance from one another on both sides of the container.

3. The container according to claim 1, wherein each supporting member further includes a casing penetrated by the supporting bracket.

4. The container according to claim 3, wherein the casing has molded clamps attached to wires of the container.

5. The container according to claim 4, wherein one of the wires has a leg extending towards the casing and engaging into the casing so that the leg forms a bearing axis for the angle lever.

6. The container according to claim 3, wherein the commonly operated handle has spring-loaded pins that engage into holes of the angle levers.

7. The container according to claim 3, wherein each supporting bracket has a longitudinal slot along its longitudinal axis, that engages a spring-loaded nose on the casing.

8. The container according to claim 3, wherein one or more of the casings, the angle levers and the commonly operated handle are made of synthetic material.

9. The container according to claim 3, wherein the commonly operated handle is formed as a wire yoke.

10. The container according to claim 3, wherein the commonly operated handle is formed with recessed grips.

11. The container according to claim 3, wherein the angle levers include one of springs and molded resilient brackets.

12. The container according to claim 3, wherein the angle levers are formed with the index stops at one end and connect to the commonly operated handle at the other end.

13. The container according to claim 3, wherein the angle levers are pivotally connected with a bearing surface inside the casings.

14. The container according to claim 1, wherein the supporting brackets are made of metal.

* * * * *